US005762590A

United States Patent [19]

St. Fleur et al.

[11] Patent Number: 5,762,590

[45] Date of Patent: Jun. 9, 1998

[54] CALF MUSCLE EXERCISE MACHINE

[75] Inventors: Daniel St. Fleur, Rego Park; Jose Enrique Donato, Brooklyn, both of N.Y.

[73] Assignee: Soleus, Inc., Rego Park, N.Y.

[21] Appl. No.: 768,032

[22] Filed: Dec. 13, 1996

[51] Int. Cl.[6] ..... A63B 21/08

[52] U.S. Cl. ..... 482/97; 482/104; 482/142; 482/134; 482/135

[58] Field of Search ..... 482/97, 104, 133, 482/134, 135, 142

[56] References Cited

U.S. PATENT DOCUMENTS

| | | |
|---|---|---|
| 4,270,749 | 6/1981 | Hebern . |
| 4,591,149 | 5/1986 | Godfrey . |
| 5,050,868 | 9/1991 | Pearson . |
| 5,123,885 | 6/1992 | Shields . |
| 5,135,457 | 8/1992 | Caruso . |
| 5,158,518 | 10/1992 | Pizzuto . |
| 5,221,242 | 6/1993 | Weber et al. . |
| 5,310,395 | 5/1994 | Ko . |
| 5,352,185 | 10/1994 | Blauth et al. . |
| 5,487,711 | 1/1996 | Little . |

*Primary Examiner*—Lynne A. Reichard

*Attorney, Agent, or Firm*—Jack J. Schwartz

[57] ABSTRACT

A device for exercising the calf muscles of a user including a frame formed of a base and two substantially parallel diagonal beams extending from either side of the base forming an acute angle with the base. A pad, contoured for accommodating a front side of at least one of the user's thighs is connected between the diagonal beams and extends at an angle adjustable within an obtuse angle supplementary with the acute angle. A weight bar is movable along the length of both diagonal beams and is releasably held at a plurality of different heights above the base. The machine is operable between a first secured mode securing the weight bar at a desired one of the plurality of different heights and a second released mode releasing the weight bar from its secured position. Connected to the weight bar is at least one foot pedal having an engagement side substantially facing the contoured pad, the angle of the contoured pad and the height of the weight bar are adjusted to accommodate the physical dimensions of the user wherein, when the machine is operating in the second in use mode, at least one of the user's associated thighs is accommodated by the contours of the contoured pad, the associated lower leg of the user extends at an angle substantially equal to that of the diagonal beams and at least one of the user's feet contact the foot pedal.

17 Claims, 5 Drawing Sheets

CALF MUSCLE EXERCISE MACHINE

BACKGROUND OF THE INVENTION

1. Field of the Invention

This invention relates to exercise machines and, more particularly, to an exercise machine for isolating, exercising and developing the calf muscles of a user.

2. Description of the Related Art

Weightlifting machines for exercising particular areas of the body are generally well known. Prior to use, the machine is adjusted to accommodate the physical dimensions of a user's body and the desired amount of weight to be lifted or resistance force to act against is placed or set on the machine. Certain machines have set predetermined weight lifting amounts while others allow for the addition of an unlimited amount of free independent weights for lifting or even include spring mechanisms for setting resistance forces to be acted against The user then enters the machine and moves into the proper position for exercising. The exercise position varies from machine to machine based upon the structure of the machine and the muscle(s) to be exercised. Once correctly positioned within the machine, the user flexes and then relaxes the muscles which are desired to be exercised thereby working the flexed muscles causing them to both strengthen and develop. The type of machine used, the position of the user, the muscles flexed and the amount of weight lifted determine the muscles that will be exercised and the extent to which they will strengthen and develop.

Certain body positions and muscular movements have been found to be particularly advantageous for isolating a particular muscle of the body for exercise and providing the greatest results in terms of developing and strengthening that muscle. The optimal body positions and muscular movements differ depending on the muscle to be exercised. Known machines for exercising and developing the calf muscles generally position the user in an upright standing position. The user then grabs a support rail to provide balance, and flexes and relaxes the calf muscle(s), causing the feet to pivot about the ankle joint Exercising the calf muscles in this manner provides a less intensive workout as the exercise does not isolate the workout on the calf muscles, additional muscles such as the foot muscles, ankle muscles and even the muscles of the arm which are used in maintaining the user's balance are active in performing such an exercise.

Such a device is disclosed in U.S. Pat. No. 4,270,749. This patent describes an exercising device including a frame forming a stall within which the user stands. A treadle/pivotable pedal is mounted on brackets within the stall and pivots about an axis a few feet above and extending through the base of the stall. In use, the user stands on the treadle and grasps side rails of the frame. The user then bends at the ankles causing the treadle to pivot This device uses no additional weight and thus does not workout the calf muscles to the greatest possible extent Furthermore, as discussed above, this device does not provide an isolated workout for the calf muscles of the user as the feet, ankles and arms are also involved and exercised. This device is one example of numerous similar devices which position the user in an upright standing position to exercise the muscles of the leg.

U.S. Pat. No. 5,135,457 describes an exercise machine including a slideable bench on which a user lies face up. The knees of the user are positioned within a brace and the user's feet are positioned against a leverage arm connected to a tension device which resists movement of the leverage arm.

As the user flexes and relaxes the foot muscles, the tension device exerts a pressure against the feet via the leverage arm thus exercising the muscles of the lower leg of the user. This device also provides for an adjustable bench to adapt the device to the physical dimensions of a user.

U.S. Pat. No. 4,591,149 describes a device on which the user is in a seated position, the feet of the user being positioned beneath a tensioned bar. When the front of the user's feet are lifted the tensioned bar exerts a pressure against the upward force of the feet allowing the lower leg muscles to be exercised.

The above-mentioned devices, however, are unable to provide a device which is able to isolate the calf muscles of a user while allowing for an unlimited workout weight to thereby provide a concentrated exercise for strengthening and developing the calf muscles both exclusively and optimally.

It is, therefore, desired to provide an exercise machine which will isolate the calf muscles of a user during a workout and thus increase the strength and development of the calf muscles.

SUMMARY OF THE INVENTION

It is, therefore, an object of the calf muscle exercise machine of the present invention to provide an exercise device which isolates the calf muscles of a user during a workout It is another object of the calf muscle exercise machine of the present invention to provide an exercise device which is able to provide a complete exhaustive workout for the calf muscles of a user.

It is a further object of the calf muscle exercise machine of the present invention to provide an exercise device which positions the user in a manner providing full use of the calf muscles without assistance from or exercise of other muscles of the body.

A still further object of the calf muscle exercise machine of the present invention is to provide an exercise device including a manually controlled safety mechanism for securing a weighted load lifted during use upon completion of an exercise set or inability of the user to complete the exercise set thereby preventing injury to a user.

An even further object of the calf muscle exercise machine of the present invention is to provide an exercise device which minimizes the amount of stress applied to the rest of the users body.

A still further object of the calf muscle exercise machine of the present invention is to provide an exercise device which is able to effectively hold an unlimited workout weight and thereby provide a complete calf muscle workout to all potential users.

An even further object of the calf muscle exercise machine of the present invention is to provide an exercise device which exercises the calf muscles only, thus, preventing prolonged use by exercisers working out other muscles of the body and eliminating the amount of waiting time to use the device in a health club environment.

A yet further object of the calf muscle exercise machine of the present invention is to provide an exercise device which is able to exercise each leg of an exerciser individually and thus aid in the rehabilitation of an injury to the calf.

These and other objects are provided by a calf muscle exercise machine including a frame formed of a base and two substantially parallel diagonal beams extending from either side of the base forming an acute angle with the base.

A pad, contoured for accommodating a front side of at least one of the user's thighs is connected between the diagonal beams and extends at an angle adjustable through an obtuse angle supplementary with the acute angle formed by the meeting of the diagonal beams and the base. A weight bar is movable along the length of both diagonal beams and is releasably held at a plurality of different heights above the base. The machine is operable between a first secured mode securing the weight bar at a desired one of the plurality of different heights and a second released mode releasing the weight bar from its secured position. Connected to the weight bar is at least one foot pedal having an engagement side substantially facing the contoured pad, the angle of the contoured pad and the height of the weight bar are adjusted to accommodate the physical dimensions of the user wherein, when the machine is operating in the second released mode, at least one of the user's associated thighs is accommodated by the contours of the contoured pad, the associated lower leg of the user extends at an angle substantially equal to that of the diagonal beams and at least one of the user's feet contact the foot pedal.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims.

BRIEF DESCRIPTION OF THE DRAWINGS

In the drawings, in which like reference numerals denote similar elements throughout the several views.

DETAILED DESCRIPTION OF THE PRESENTLY PREFERRED EMBODIMENTS

Figure 1:
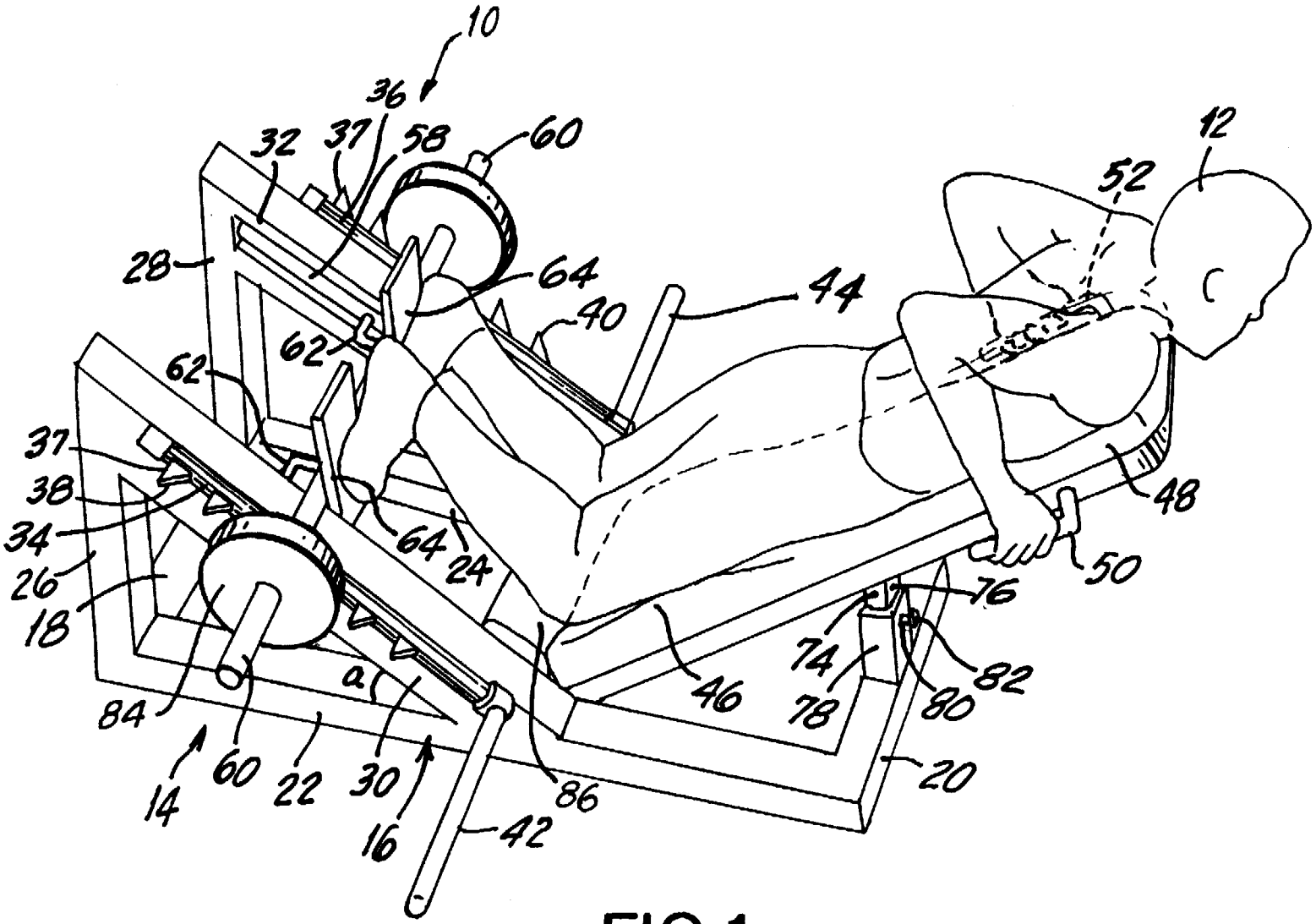
FIG. 1 is a left side perspective view of the calf muscle exercise machine of the present invention.

Referring now to FIGS. 1–8 a preferred embodiment of the calf muscle exercise machine of the present invention is illustrated and indicated generally by the number 10. A user 12 is shown in FIG. 1 in the proper position within the machine 10 to begin exercising.

Figure 8:
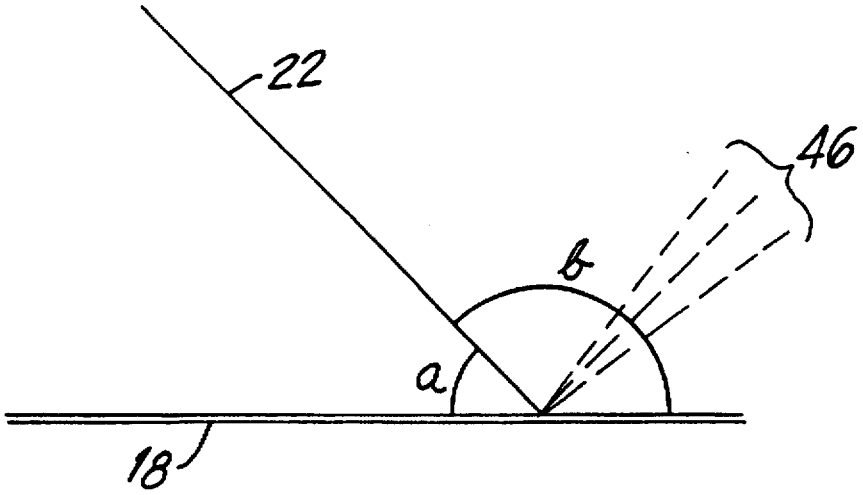
FIG. 8 is a geometric diagram illustrating the angular relationship between the base, diagonal beams and contoured pad.

The machine 10 includes a frame 14 having a base 16. The base 16 is formed by left and right length side beams 22 and 24, respectively. As depicted in the figures, the left and right length side beams 22, 24 may be connected together by a front beam 18 and a rear beam 20 and secured at a constant separation distance equal to the length of the front and rear beams 18, 20. Alternatively, the front and rear beams 18, 20 may be replaced by a single cross beam connecting the left and right length side beams 22, 24 positioned anywhere along the length of the beams; by three individual cross beams connecting the left and right length side beams, a first beam positioned at the front side of the base, a second beam positioned at the rear side of the base and a third beam positioned between the first and second beams; or any other configuration which will connect the left and right length side beams and maintain their position with respect to one another. While a preferred structure for connecting the left and right length side beams and maintaining a constant position is shown and described herein, those of ordinary skill in the art who have read this description will appreciate that there are numerous other structures for connecting and maintaining a constant separation distance between the left and right length side beams and, therefore, as used herein the phrase "means for connecting the left and right length side beams" should be construed as including all such structures as long as they achieve the desired result of connecting and maintaining a constant position of the left and right length side beams, and therefore, that all such alternative mechanisms are to be considered as equivalent to the one described herein. The figures also depict the left and right length side beams as being substantially parallel, in actuality the beams may extend in any relationship to one another as long as the positioning of the beams remains constant First and second substantially parallel diagonal support beams 30, 32 each extend from a respective one of the left and right length side beams 22, 24. FIG. 8 illustrates the relationship between the diagonal beams and their respective length side. The diagonal beams 30, 32 are aligned with each other and extend from the front side of the respective length side 22 or 24 towards the rear side forming an acute angle (a) facing the rear side of the base and an obtuse angle (b) supplementary to the acute angle (a) facing the front side of the base. The diagonal beams 30, 32 may be made of steel, iron, plastic, any alloy thereof or any other rigid strong material able to withstand a force exerted by a large amount of weight placed thereon and necessary for proper operation of the machine. First and second vertical support poles 26, 28 may extend perpendicular to the base 14 from a rear side of the left and right length side beams 22, 24 to provide additional support for the diagonal beams 30, 32 and thus allow for a greater amount of weight to be supported by the diagonal beams 30, 32. Based upon the strength of the diagonal beams 30, 32 and the intended amount of weight to be placed thereon, the vertical support poles 26, 28 may not be necessary for providing additional support to the diagonal beams and thus can be eliminated. The connection between the respective diagonal beams 30, 32, length side beams 22, 24 and vertical support poles 26, 28 form two substantially right triangles. The connection between the first and second diagonal support beams 30, 32 and the respective first and second length side beams 22, 24 may be spaced a distance from the front side of the base 16.

Pivotally connected between the diagonal beams 30, 32 and adjustable through the obtuse angle (b) formed by the diagonal beams and the base is a contoured pad 46. The contoured pad 46 has at least one and preferably two contours extending along its length to receive a front side of at least one of a user's thighs and the associated knees. The contoured pad 46 is most clearly illustrated in FIG. 2. By angularly adjusting the contoured pad, the angle of inclination of the contoured pad 46 may be set by the user. The contoured pad 46 may be formed of a single pad or may be in multiple contoured pieces, e.g. one contoured pad for accommodating each thigh and an associated knee of a user. While a preferred structure for the contoured pad is shown and described herein, those of ordinary skill in the art who have read this description will appreciate that there are numerous other structures for the contoured pad and, therefore, as used herein the phrase "contoured pad means for accommodating a front side of at least one thigh of a user" should be construed as including all such structures as long as they achieve the desired result of accommodating a front side of a thigh of a user, and therefore, that all such alternative structures for a contoured pad are to be considered as equivalent to the one described herein.

Figure 3:
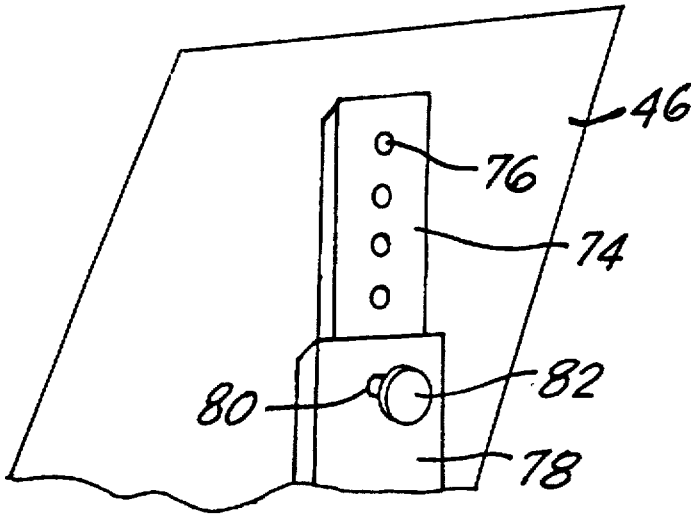
FIG. 3 is a front view of the adjustment device.

Adjustment of the angle of inclination through the obtuse angle and securing the contoured pad 46 in place may be performed using any such known device. A preferred adjusting device is illustrated in FIG. 3 and consists of a hollow bar 74 extending from an underside of the contoured pad 46 and having a plurality of recesses 76 aligned along its length; a receiving device 78 including a single recess 80 extending from the front side of the base 16 and aligned to receive the hollow bar 74; and a securing pin 82. The securing pin 82 is inserted to extend through the recess 80 in the receiving device 78 and a desired one of the plurality of recesses 76 in the hollow bar 74 thus locking the contoured pad 46 in place at a desired angle of inclination. If it is desired to change the angle at which the contoured pad 46 extends relative to the base 16, the securing pin 82 is removed and the contoured pad 46 is either lifted or lowered until the desired angle is obtained. The securing pin 82 is then reinserted through the recess 80 in the receiving device 78 and an aligned recess 76 in the bar 74 to lock the contoured pad 46 at the desired angle of inclination.

Figure 2:
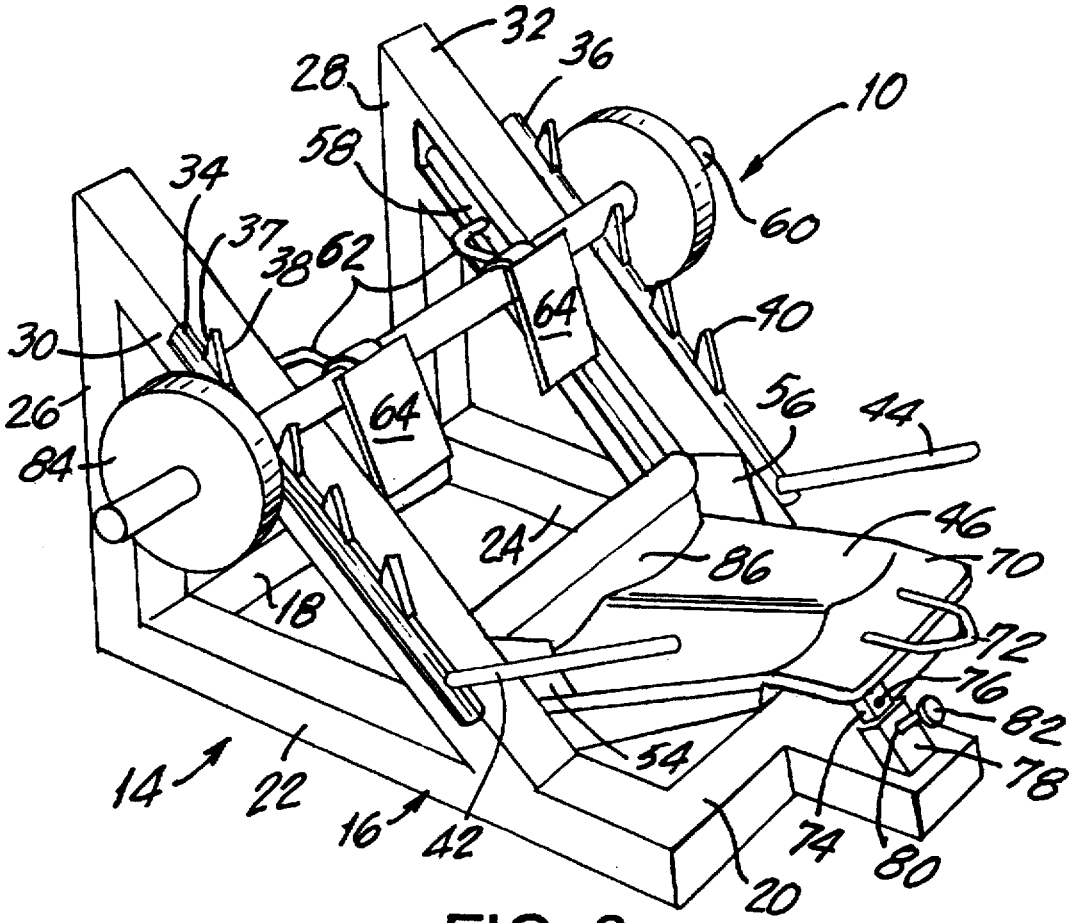
FIG. 2 is a left side perspective view of the calf muscle exercise machine of FIG. 1 including an elbow pad.

In the preferred embodiment shown in FIGS. 1 and 2, a knee brace 54, 56 is attached on either side of the contoured pad 46 for aiding in retaining the knees and thighs of the user within the contours of the contoured pad 46. Each knee brace 54, 56 is positioned between the contoured pad 46 and a respective one of the first and second diagonal beams 30, 32. A rest pad 86 may also be connected between the diagonal beams 30, 32 in a position above the contours of the contoured pad 46 for holding the thighs and knees of the user 12 in position on the contours of the contoured pad 46 thereby prohibiting the knees of the user from sliding beyond and off the contoured pad 46.

A second pad 48, as shown in FIG. 1, may be connected to and extend from the contoured pad 46 to accommodate the torso of the user 12. The torso pad 48 includes support handles 50, 52 extending from an underside thereof. The support handles 50, 52 may be grasped by the user 12 during use of the machine 10 to provide additional support Alternatively, an elbow pad or arm rest 70 as depicted in FIG. 2 may be connected to extend from the contoured pad 46 in lieu of the torso pad 48 of FIG. 1. A support handle 72 extends from a center portion of the elbow pad 70 providing added support for the user similar to the support provided by the support handles 50, 52 extending from the torso pad 48. In this embodiment, the user would lie in a propped up position supporting the torso by the elbows instead of a prone position face down as when using the torso pad 48. Alternatively, the contoured pad 46 and either the torso pad 48 or the elbow pad 70 may be combined as a single pad.

Extending from a base of and along the length of each diagonal support beam 30, 32 is a support rod 34, 36. Each support rod 34, 36 is pivotable about an axis extending parallel to the respective diagonal support beam 30,32. Extending outward from and along the entire length of each pivotable support rod 34, 36 are a plurality of teeth 38, 40. Each of the plurality of teeth is formed as a saw tooth having a flat upper side 37. The plurality of teeth are made of a strong extremely rigid material able to withstand a great amount of pressure exerted by a weighted load placed thereon. Each of the plurality of teeth extending from one of the pivotal support rods is aligned with a corresponding one of the plurality of teeth on the other pivotal support rod to form a plurality of aligned tooth pairs. The flat upper side of each of the plurality of teeth extending from both pivotal support rods 34, 36 may include a padded material covering. The padded material covering may be made of foam rubber, soft plastic, sponge material, any combination thereof or any other soft flexible material which is able to cushion the teeth from placement of a load of substantial weight thereon. The padded covering should also provide a frictional surface to aid in holding and retaining the load in a rest position atop the aligned tooth pair on which it is placed.

A control bar 42, 44 extends from a base of each pivotable support rod 34, 36. Each control bar 42, 44 is positioned below and extends parallel to a respective plurality of teeth for manually pivoting the respective plurality of teeth and support rod 34, 36 to which it is connected. The control bars 34, 36 have a length long enough to extend along either side of the torso pad 48 depicted in FIG. 1 or the elbow pad 70 depicted in FIG. 2 and thus may be easily gripped by a user correctly positioned within the machine to pivot the plurality of teeth for releasing or supporting a load.

Also extending along the length of each diagonal beam 30, 32 is a weight guide 58. A weight bar 60 is connected to the weight guide 58 by slideable clamps 62 which are connected to and moveable along the length of the weight guide 58. The weight bar 60 is positioned to extend perpendicular to the diagonal beams 30, 32. The thickness of the weight bar 60 is less than the distance between the plurality of teeth on each support rod thus allowing the weight bar 60 to easily fit between any two adjacent teeth extending from each support bar. The slideable clamps 62 act to guide the movement of the weight bar 60 during adjustment and use along the length of the weight guide 58. This provides an added safety feature as the weight bar 60 is restricted in its movement and the user does not have to independently balance the weight bar 60 on their feet The weight bar 60 has a length greater than the distance between the diagonal beams 30, 32 and thus extends on either side of the diagonal beams 30, 32 when positioned on and held at a desired height by an aligned tooth pair. The padded material covering on the top side 37 of the teeth act to cushion the teeth when the weight bar 60 is placed thereon and the frictional surface acts to hold the weight bar 60 in a secured position atop a respective aligned tooth pair. Attached to the weight bar 60 and positioned between the diagonal beams 30, 32 is at least one foot pedal 64 for engagement by either one or both feet of the user 12. Additional independent weights 84 may be positioned on either side of the weight bar 60 to increase the amount of weight to be lifted and provide a more intensive workout for the user. When increasing the amount of weight placed on the weight bar 60 it is recommended that an equal amount of additional weights 84 be secured on both sides of the weight bar 60 to evenly balance the weight bar 60.

Figure 4:
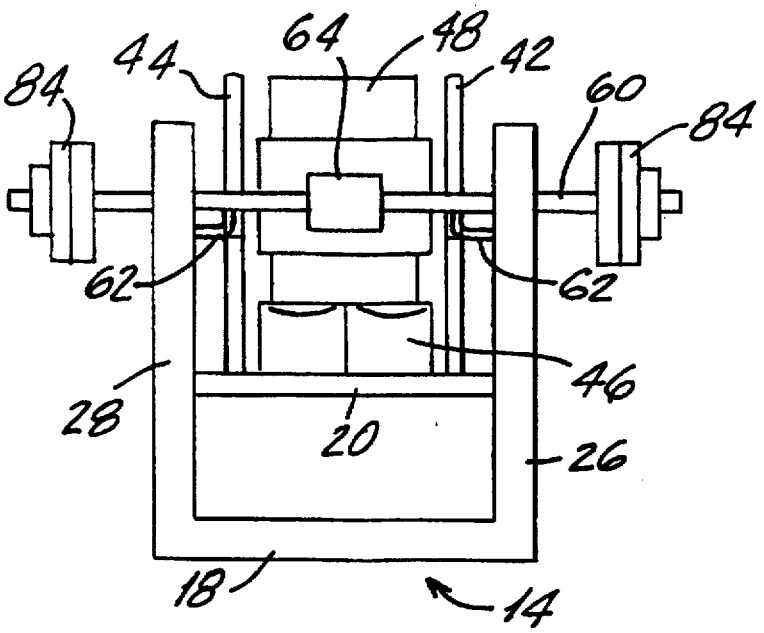
FIG. 4 is a rear view of the calf muscle exercise machine of FIG. 1.
Figure 5:
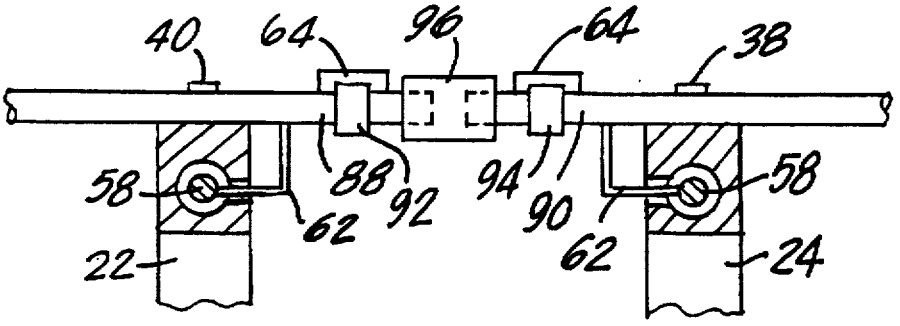
FIG. 5 is a partial cross-sectional top view depicting the connection between the support rods and individual weight bar sections via the slideable clamps.

FIG. 4 and, more particularly, FIG. 5 shows the connection of the foot pedal 64 to the weight bar 60 and the weight bar 60 to the weight guides 58 via the slideable clamps 62.

FIG. 4 illustrates a rear view of the machine 10 and use of a single weight bar 60 connected to both weight guides 58, one attached to each diagonal beam 42, 44. One slideable clamp 62 is attached between each weight guide 58 and a respective side of the weight bar 60. In this embodiment it is possible to use either one or more foot pedals 64 for exercising the calf muscles of either or both legs at one time.

FIG. 5 illustrates a top view of an embodiment in which the weight bar 60 is separated into two independent weight bar sections 88, 90. In this instance each weight bar section 88, 90 is slideably connected to a respective weight guide 58 via a slideable clamp 62. Each weight bar section 88, 90 extends on either side of the weight guide 58 and thus also extends on either side of the diagonal beam 30, 32 to which it is connected. A foot pedal 64 is connected by a respective clamp 92, 94 to a portion of each weight bar section extending between the two diagonal beams. An embodiment as illustrated in FIG. 5 is particularly useful for persons who have sustained leg injuries and are unable to lift an equal amount of weight with both legs. Each leg can be exercised independently of the other. The user is also able to place a different amount of weight on each weight bar section and, thus, allow each calf muscle to receive an optimal workout based upon the strength of each muscle. Alternatively, a clamping device 96 can be provided which acts to connect the individual weight bar sections 88, 90 allowing them to work together as a single unit and provide an equal workout for both calf muscles. The use of the control bars to hold and release the weight bar sections is identical to that with a single weight bar. However, with two weight bar sections, each section may be held and released by the control bars independently.

Figure 6:
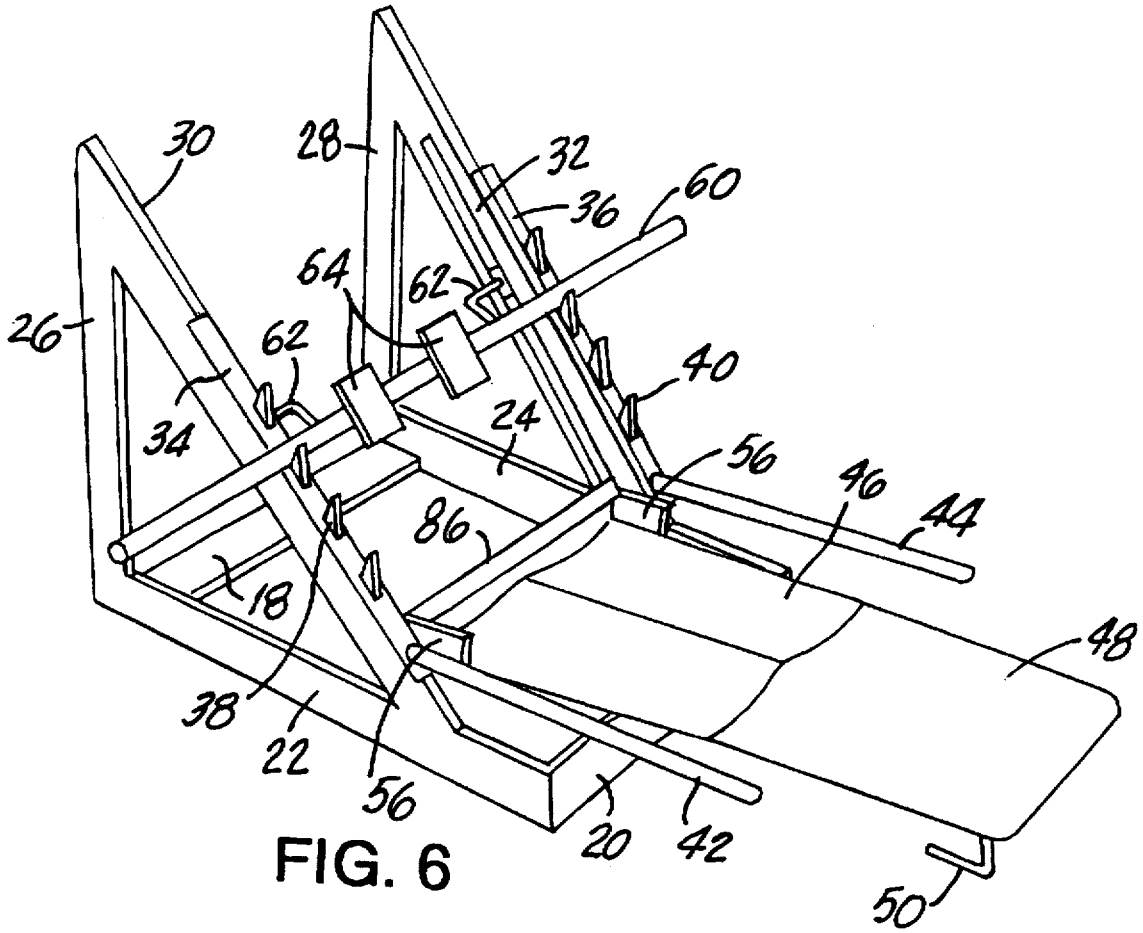
FIG. 6 is a perspective view of the calf muscle exercise machine of FIG. 1 illustrating the control bars in a first secured position.
Figure 7:
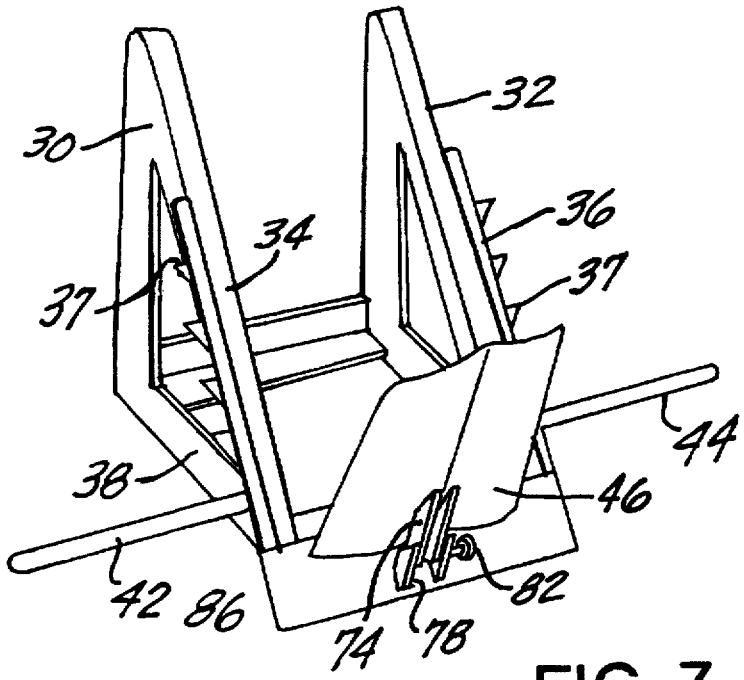
FIG. 7 is a perspective view of the calf muscle exercise machine of FIG. 1 illustrating the control bars in a second released position.

FIGS. 6 and 7 illustrate the use of the control bars 42, 44. FIG. 6 illustrates the closed rest position or secured mode and FIG. 7 illustrates the open released position or operating mode. As can be seen from FIG. 6, the control bars 42, 44 and plurality of teeth 38, 40 attached to the respective pivotable support rods 34, 36 all extend in a direction parallel to the left and right length side beams 22, 24 and the associated diagonal beams 30, 32. In this position, the plurality of teeth extend perpendicular to the weight bar 60 acting to secure the weight bar 60 on the flat side 37 of the aligned tooth pair directly below.

FIG. 7 depicts the control bars 34, 36 and plurality of teeth 38, 40 rotated to extend at an angle to the left and right length side beams 22, 24 and the associated diagonal beams 30, 32. In this position the plurality of teeth do not extend parallel with the left and right length side beams 22, 24 and associated diagonal beams 30, 32 and thus the weight bar (not shown here) is not supported by the teeth. The control bars and teeth are placed in this position when adjusting the height of the weight bar 60 and during use of the machine 10. In order to release the weight bar 60 from its position atop the flat side of the pair of aligned teeth and pivot the control bars 34, 36 into this position, the user must first lift the weight bar 60 from contacting the pair of aligned teeth on which it rests. The lifting of the weight bar 60 is normally performed by the user when in position to use the machine, as will be described hereinafter. When the machine includes two weight bar sections as depicted in FIG. 5 the control bars 34, 36 need not be pivoted at the same time to release both weight bars 60 but can be individually pivoted to release one weight bar section and work one calf muscle at a time.

In operation, the machine is originally set in the first secured position with the weight bar securely positioned atop an aligned tooth pair extending from the support bar. The user will place a desired amount of independent or free weights on either side of the weight bar until an optimal workout weight is placed on the weight bar and the free weights are secured on the bar using any known type of clamp. If a split weight bar as depicted in FIG. 5 is used, independent or free weights need only be placed on one of the two weight bar sections for use in exercising a single calf muscle. The user will then release the pin holding the contoured pad in its angled position and adjust the angle of the pad to the desired inclination by lifting or lowering the contoured pad through the obtuse angle formed by the connection between the diagonal beams and the left and right length sides. When the desired angle is obtained, the pin is reinserted through the aligned recesses in the receiving device and hollow bar and the contoured pad is secured in position.

At this point, the user will enter the machine and lie face down on the torso pad placing the front of the thighs snugly within the contours of the contoured pad, allowing the knees to rest against both the rest pad and knee pads and the lower legs to extend toward the weight bar at an angle substantially equal to the acute angle at which the diagonal beams extend from the base. The operation of the device will now be described for exercising both calf muscles of a user. It is to be understood that operation of the device using one calf muscle is identical and thus need not be explained independently. In this position the users feet should contact the foot pedal while the knees remain securely positioned in contact with both the contoured pad and the rest bar. As the weight bar is still secured above an aligned pair of teeth, no pressure should be exerted by the weight bar on the feet and associated lower legs of the user at this time. In this position, only the user's calf muscle will act on the foot pedals and thus the remainder of the user's body will be at rest isolating the calf muscles to provide a full calf muscle workout.

If pressure is exerted by the weight bar on the lower legs of the user then the weight bar is positioned too low to fit the physical dimensions of the user's lower leg and needs to be raised or if the feet of the user are not in contact with the foot pedal while the associated knees are in contact with the contoured pad and the rest bar the weight bar needs to be lowered. In the prone face down position, the user will place the feet against the foot pedal, lifting the associated knees if necessary, and act to lift the weight bar slightly above the aligned pair of teeth on which it rests by flexing the calf muscles causing the balls of the feet to exert a pressure against the pedal. The control bars can now be rotated away from the contoured pad releasing the weight bar from its secured at rest position and placing the control bars and machine in the released in use position. The user can now lower the knees if necessary and be in the proper position for exercising with the weight bar atop the feet and at the correct height for operating the machine.

To use the machine, the user flexes the calf muscles causing the balls of the feet to be raised thereby exerting an upward pressure against the foot pedal. This causes the weight bar to be lifted and, via the sliding clamps, slide upward along the weight guide. By raising the weight bar in this manner, a gravitational force acting on the weight bar is exerted on the calf muscles of the user and thus the muscles are exercised. The user then relaxes the calf muscles thereby lowering the front of the feet and releasing the upward pressure on the foot pedals. This causes the weight bar to be lowered and, via the sliding clamps, slide downward along the weight guide. The user repeats the flexing and relaxing of the calf muscles, i.e. the exertion and release of pressure against the foot pedal, a desired number of times causing the calf muscles to be exercised with each repetition.

Upon completion of the desired number of repetitions or until the user is unable to continue, the user rotates the control bars back toward the contoured pad until the control bars and plurality of teeth extend perpendicular to the weight bar. At this point the pressure exerted against the weight bar by the feet of the user can be released, allowing the weight bar to fall and come to rest on the pair of aligned teeth directly below its current position. As the teeth are very closely spaced apart, i.e. an optimal distance of at most one inch, the weight bar will fall a distance of no more than one inch less the thickness of the bar. The cushioned padding on the teeth will act to catch the weight bar when released and the friction between the weight bar and cushioned pad will hold the weight bar in place. The user may then safely exit the machine.

Based on the structure and functioning of the present invention a complete exhaustive workout is obtained by isolating the calf muscles of a user while positioning the user in a manner which minimizes the amount of stress applied to the rest of the users body. As the present invention is also able to effectively hold an unlimited workout weight while exercising each leg of a user individually a complete calf muscle workout is obtained by all potential users and injured calf muscles can be rehabilitated during a normal workout routine. Furthermore, as the present invention performs the sole purpose of exercising the calf muscles, the amount of time spent waiting to use the device in a health club environment is minimized as the machine will not be occupied by exercisers working out other muscles of the body.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A device for exercising a user's calf muscles comprising:

a frame including:

a base having a left side beam and a right side beam; and first and second substantially parallel diagonal beams, each of said first and second diagonal beams being separated by a distance and connected to extend at an acute angle from a respective one of said left and right side beams of said base;

pad means for accommodating the user having a first contoured section for receiving and accommodating a front side of a thigh of the user and a second torso section for receiving the torso of a user, said first contoured section of said pad means being connected between said first and second diagonal beams, said second torso section extending from said first contoured section at a side opposite said connection between said first and second diagonal beams and said pad means being angularly adjustable through an obtuse angle supplementary to said acute angle;

a weight bar engaged with and movable along said first and second diagonal beams;

means for releasably engaging said weight bar connected to both said first and second beams and defining a plurality of heights along said first and second diagonal beams, said means for releasably engaging being movable between a first secured position engaging and securing said weight bar in position at one of said plurality of heights and a second released position disengaged from and releasing said weight bar from its secured position; and at least one foot pedal connected to said weight bar and having an engagement side facing said pad means, the angle of extension of said pad means and the height of said weight bar being adjustable for accommodating the physical dimensions of the user wherein when at least one of said user's feet are positioned to contact said engagement side of said at least one foot pedal, said user's associated thigh is accommodated by said first contoured section and the associated lower leg of the user extends at an angle.

2. The device as claimed in claim 1, wherein said means for releasably holding comprises:

first and second rods pivotable between said first secured position and second released position, each connected to and extending along a respective one of said first and second diagonal beams;

a first and second plurality of teeth each having a first receiving side and being connected to extend from and pivot with a respective one of said first and second rods; and first and second control bars each extending from and pivotable with a respective one of said first and second pivotable bars, wherein said first and second plurality of teeth and said first and second control bars, respectively, extend parallel to each other, each tooth of said first plurality of teeth being aligned with a respective tooth of said second plurality of teeth to form a plurality of aligned tooth pairs, each of said plurality of aligned tooth pairs defining one of said plurality of heights wherein said first and second plurality of teeth and said first and second control bars extend perpendicular to said weight bar for securing said weight bar at one of said plurality of heights on said receiving side of a respective aligned tooth pair when said first and second rods are in said first secured position.

3. The device as claimed in claim 2, wherein said first and second control bars and said first and second plurality of teeth all extend at an angle to said contoured pad when said first and second rods are in said second released position.

4. The device as claimed in claim 3, wherein said at least one foot pedal includes first and second pedals and said weight bar includes first and second weight bar sections each of said first and second weight bar sections being connected to a respective one of said first and second pedals and being independently movable along a respective one of said first and second diagonal beams.

5. The device of claim 4, further comprising:

first and second weight guides each connected to and extending along a respective one of said first and second diagonal beams; and first and second slideable clamps each connected between a respective one of said first and second weight guides and a respective one of said left and right weight bar sections, each of said first and second slideable clamps for individually guiding a respective one of said left and right weight bar sections along said length of said respective first and second weight guides when a respective one of said first and second rods is in said second released position.

6. The device of claim 3, further comprising:

first and second weight guides each connected to and extending along a respective one of said first and second diagonal beams; and first and second slideable clamps each connected between said weight bar and a respective one of said first and second weight guides for guiding said weight bar along said length of said first and second diagonal beams when said first and second rods are in said second released position.

7. The device as claimed in claim 2, wherein each of said teeth of said first and second plurality of teeth include a material covering on said receiving side for more securely holding said weight bar in place.

8. The device as claimed in claim 7, wherein said material covering is formed of one of foam rubber, soft plastic and sponge material.

9. The device as claimed in claim 2, wherein said pad means includes first and second pads, said first pad including said first contoured section and said second pad including said second torso section, left and right sides and first and second handles, each of said first and second handles extending from a respective one of said left and right sides for grasping by and providing support to a user, said control bars extending parallel to and along either side of said second pad when in said first secured position.

10. The device of claim 1, further comprising first and second knee braces each positioned between a respective one of said first and second diagonal beams and said contoured pad for preventing a user's knee from sliding off said contoured pad.

11. The device of claim 10, wherein said contoured pad further includes a knee brace connected to and extending between said first and second diagonal beams at said connection between said contoured pad and said base for preventing a user's knees from extending beyond the connection between said contoured pad and said first and second diagonal beams.

12. The device as claimed in claim 1, further comprising means for angularly adjusting said contoured pad.

13. The device as claimed in claim 1, wherein said frame is made of iron, steel, any alloy thereof or plastic.

14. The device as claimed in claim 1, wherein said left and right sides of said base are separated by a distance equal to the separation distance of said diagonal beams and said base further includes means for connecting said left and right sides to maintain said separation distance.

15. A device for exercising a user's calf muscles comprising:

a) a frame including:

a base having a left side beam and a right side beam; and first and second substantially parallel diagonal beams, each of said first and second diagonal beams being separated by a distance and connected to extend at an acute angle from a respective one of said left and right side beams of said base;

b) pad means for accommodating the user having a first contoured section for receiving and accommodating a front side of a thigh of the user and a second elbow section for receiving at least one elbow of a user and including a first end, said first contoured section of said pad means being connected between said first and second diagonal beams, said second elbow receiving section being connected at said first end to said first contoured section at a side opposite said connection with said first and second diagonal beams and angularly adjustable through an obtuse angle supplementary to said acute angle;

c) a weight bar engaged with and movable along said first and second diagonal beams;

d) means for releasably engaging said weight bar connected to both said first and second beams and defining a plurality of heights along said first and second diagonal beams, said means for releasably engaging being movable between a first secured position engaging and securing said weight bar in position at one of said plurality of heights and a second released position disengaged from and releasing said weight bar from its secured position; and e) at least one foot pedal connected to said weight bar and having an engagement side facing said pad means, the angle of extension of said pad means and the height of said weight bar being adjustable for accommodating the physical dimensions of the user wherein when at least one of said user's feet are positioned to contact said engagement side of said at least one foot pedal, said user's associated thigh is accommodated by said first contoured section and the associated lower leg of the user extends at an angle with said base equal to said acute angle.

16. The device as claimed in claim 15, wherein said means for releasably holding comprises:

a) first and second rods pivotable between said first secured position and second released position, each connected to and extending along a respective one of said first and second diagonal beams;

b) a first and second plurality of teeth each having a first receiving side and being connected to extend from and pivot with a respective one of said first and second rods; and c) first and second control bars each extending from and pivotable with a respective one of said first and second pivotable bars, wherein said first and second plurality of teeth and said first and second control bars, respectively, extend parallel to each other, each tooth of said first plurality of teeth being aligned with a respective tooth of said second plurality of teeth to form a plurality of aligned tooth pairs, each of said plurality of aligned tooth pairs defining one of said plurality of heights wherein said first and second plurality of teeth and said first and second control bars extend perpendicular to said weight bar for securing said weight bar at one of said plurality of heights on said receiving side of a respective aligned tooth pair when said first and second rods are in said first secured position.

17. The device as claimed in claim 16, wherein said pad means includes first and second pads, said first pad including said first contoured section and said second pad including said second elbow section, first and second ends and a handle, said second pad being connected at said first end to said first pad at a side opposite said connection with said first and second diagonal beams and said handle connected to extend from said second end of said second pad for grasping by and providing additional support to a user, said control bars extending parallel to and along either side of said second pad when in said first secured position.

* * * * *